US007963063B2

(12) United States Patent
Camarillo

(10) Patent No.: US 7,963,063 B2
(45) Date of Patent: Jun. 21, 2011

(54) DEVICE FOR PREVENTING DUST AND MOISTURE FROM ENTERING A FIREARM BARREL

(75) Inventor: Jimmy G. Camarillo, New Braunfels, TX (US)

(73) Assignee: Camco One Industries, LLC, San Antonio, TX (US)

( * ) Notice: Subject to any disclaimer, the term of this patent is extended or adjusted under 35 U.S.C. 154(b) by 879 days.

(21) Appl. No.: 11/849,392

(22) Filed: Sep. 4, 2007

(65) Prior Publication Data

US 2011/0000122 A1 Jan. 6, 2011

Related U.S. Application Data

(60) Provisional application No. 60/842,691, filed on Sep. 6, 2006.

(51) Int. Cl.
*F41A 27/00* (2006.01)

(52) U.S. Cl. ..... 42/96

(58) Field of Classification Search ..... 42/96, 70.11, 42/85; 89/29, 30

See application file for complete search history.

(56) References Cited

U.S. PATENT DOCUMENTS

| | | | | | |
|---|---|---|---|---|---|
| 44,631 | A * | 10/1864 | Hull | 89/5 |
| 540,748 | A * | 6/1895 | Layton | 89/31 |
| 1,089,086 | A * | 3/1914 | Sikes | 42/111 |
| 1,499,460 | A * | 7/1924 | Kennedy | 15/104.05 |
| 1,537,517 | A * | 5/1925 | Wheeling | 42/96 |
| 2,385,051 | A * | 9/1945 | Berlin et al. | 89/31 |
| 2,465,163 | A * | 3/1949 | Lockwood | 42/96 |
| 2,545,473 | A * | 3/1951 | Kremkau | 42/96 |
| 2,557,277 | A * | 6/1951 | Gibson | 42/96 |
| 2,558,792 | A * | 7/1951 | Snowden | 42/96 |
| 2,906,175 | A * | 9/1959 | Mohaupt | 89/1.1 |
| 2,983,063 | A * | 5/1961 | Douville et al. | 42/1.11 |
| 3,063,184 | A * | 11/1962 | Sukala, Jr. | 42/96 |
| 3,354,569 | A * | 11/1967 | Kassabian | 42/96 |
| 3,455,047 | A * | 7/1969 | Hoag | 42/96 |
| 3,593,451 | A * | 7/1971 | McDonnell | 42/96 |
| 3,653,564 | A * | 4/1972 | Carter | 224/150 |
| 3,813,802 | A * | 6/1974 | Di Prospero | 42/96 |
| 3,849,923 | A * | 11/1974 | Hawkins | 42/96 |
| 4,084,340 | A * | 4/1978 | Scudder | 42/96 |
| 4,280,644 | A * | 7/1981 | Shindelka | 224/149 |
| D271,126 | S * | 10/1983 | Doak | D22/108 |
| 4,817,322 | A * | 4/1989 | Dietz et al. | 42/96 |
| 4,922,642 | A * | 5/1990 | Ohlhauser | 42/96 |
| 5,046,276 | A * | 9/1991 | Morris | 42/70.01 |
| 5,105,571 | A * | 4/1992 | Kinchin et al. | 42/96 |
| 6,269,579 | B1 * | 8/2001 | Warner | 42/95 |
| 6,722,073 | B2 * | 4/2004 | Cossio | 42/96 |
| 7,234,264 | B2 * | 6/2007 | Cole | 42/96 |
| 7,506,572 | B1 * | 3/2009 | Hombeck | 89/31 |
| 2003/0005614 | A1 * | 1/2003 | Cossio | 42/96 |
| 2005/0183321 | A1 * | 8/2005 | Brown | 42/96 |

* cited by examiner

*Primary Examiner* — Michelle Clement
(74) *Attorney, Agent, or Firm* — Sand & Sebolt

(57) ABSTRACT

A muzzle cover for a firearm comprising a soft, flexible and resilient member that slides over and frictionally engages the front end of the muzzle. The cover comprises a substantially cylindrical sheath that is open at a first end to receive the front end of the muzzle therein and which frictionally engages the external surface of the muzzle. A conical tip is integrally formed with the sheath and extends outwardly from the sheath and over the opening to the barrel. The conical tip may extend forwardly away from the front of the sheath or may be depressed inwardly into the bore of the sheath upon application of gentle pressure from a fingertip. The muzzle cover completely disengages from the muzzle when a projectile is fired from the weapon.

17 Claims, 4 Drawing Sheets

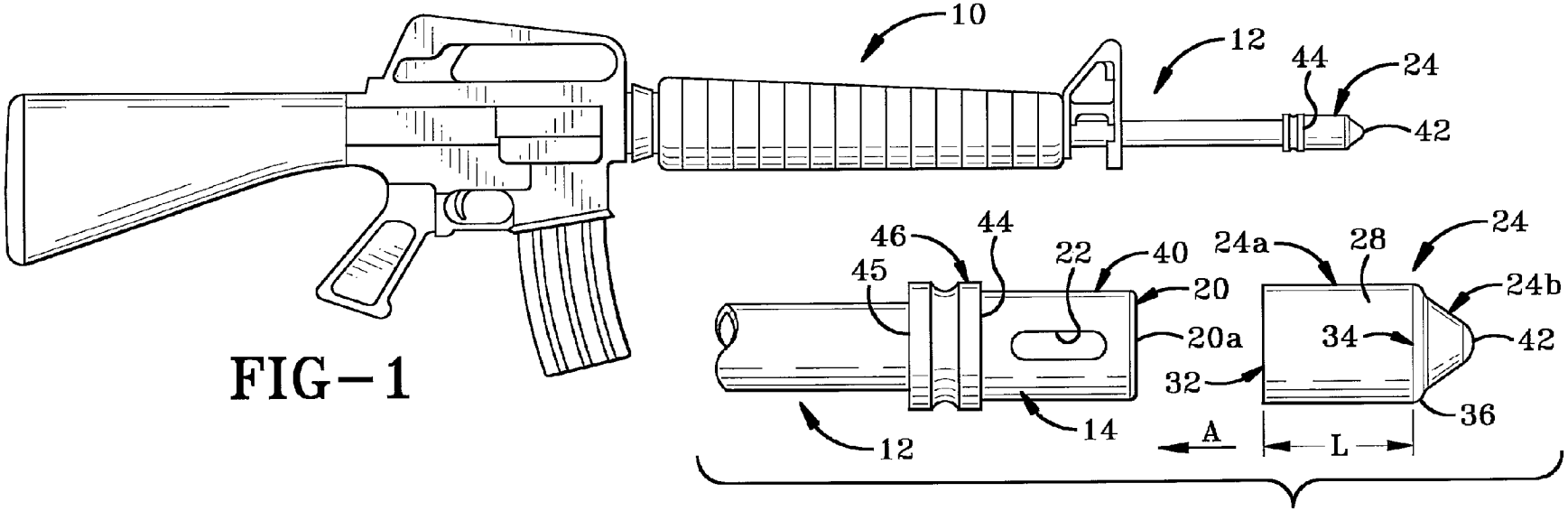
FIG-1
FIG-2
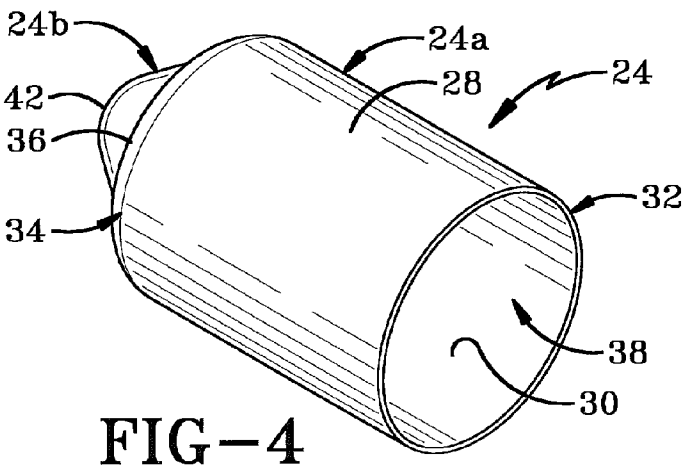
FIG-4
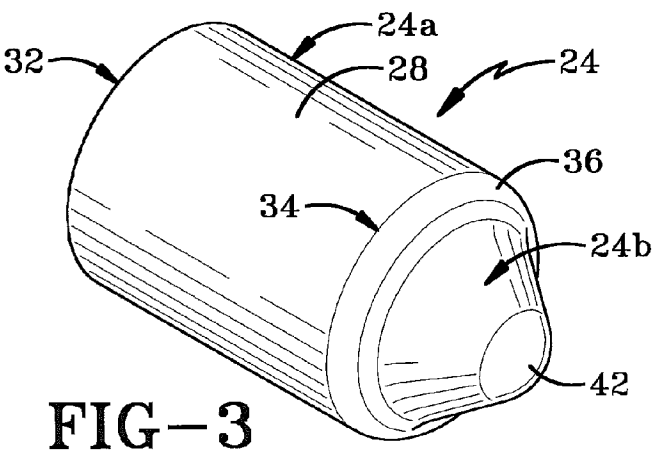
FIG-3

DEVICE FOR PREVENTING DUST AND MOISTURE FROM ENTERING A FIREARM BARREL

BACKGROUND OF THE INVENTION

1. Technical Field

This invention generally relates to firearms. More particularly, the invention relates to a protective device for preventing dust, moisture and other debris from entering the barrel of a firearm. Specifically, the invention relates to a soft, flexible protective cover that frictionally engages and covers the muzzle of a firearm when not in use, but which allows a projectile to be fired therethrough.

2. Background Information

Firearms are particularly vulnerable to dust and moisture that may enter the barrel and cause corrosion and/or interference with the firing of the weapon. This becomes a particular problem in environments such as desert areas where dust is a daunting factor or in tropical or coastal areas where moisture presents an equally serious problem.

Over the years, a number of patents have addressed this issue by disclosing a variety of covers or caps that may be installed over the muzzle of a firearm. These caps are provided to prevent the entry of dust or moisture into the barrel. U.S. Pat. No. 2,385,051 issued to Berlin et al, discloses a two-part protective device that is applied to a firearm. The device includes a tube that slides over and clamps onto a cooling sleeve provided on the muzzle of an aircraft machine gun. A cap piece fits over the end of the tube and covers off the opening to the tube. The tube is designed to block off openings in the cooling sleeve and thereby prevent the ingress of moisture and particulate matter through those openings when the machine gun is not in use.

U.S. Pat. No. 2,465,163 issued to Lockwood discloses a desiccant-filled cartridge that is insertable into the barrel of an aircraft machine gun to soak up moisture that has entered the barrel. A sealing member is pulled over the muzzle of the gun thereby securing the desiccant cartridge in the barrel. This prevents additional moisture and particulate matter from entering the barrel. When the weapon is to be fired, the desiccant-filled cartridge is ejected in the same manner as a regular cartridge.

U.S. Pat. No. 3,354,569 issued to Kassabian discloses a protector that includes a gripping portion which engages the exterior surface of the barrel and a cap assembly that blocks off access to the bore. The gripping portion includes a pair of spaced-apart retaining bands which are sufficiently elastic to grip the barrel. The retaining bands are connected to each other by strips that run along the sides of the barrel. A cap assembly extends over the muzzle and comprises a thin, cylindrical or frusto-conical sheath that extends outwardly away from one of the retaining bands. The front end of the sheath includes a closure that blocks off access to the bore of the weapon. When the firearm is to be fired, the cap assembly is slid off the muzzle, leaving at least the rearward retaining band in place. When the firearm is not in use, the protective cap is reapplied over the muzzle.

U.S. Pat. No. 5,105,571 issued to Kinchin et al discloses a muzzle cap that includes a generally cylindrical sleeve portion which circumscribes the muzzle and covers the opening therein. The cap also includes an external annular ridge that enables the cap to be pulled off the muzzle and an internal annular rib that assists in keeping the cap in gripping contact with a portion of the muzzle.

Currently, the military utilizes a plastic molded cap that slides over the front end of the muzzle and blocks off access to the bore. These plastic caps tend to crack if they are manipulated too much or if the firearm is exposed to adverse conditions, such as extreme temperature changes, for a protracted period of time. Furthermore, because the caps extend across the opening to the bore, if a soldier has an urgent need to fire his weapon, he would either have to shoot through the cap or take the time to remove the cap. Obviously, the latter instance puts the soldier at extreme risk. Furthermore, the military has found that soldiers are reluctant to fire their weapons when the current type of cap used. The reason for this may be the possible production of small pieces of shrapnel as the muzzle cap explodes under the impact of the projectile. The military has noted that soldiers tend not to use these caps and their weapons are consequently vulnerable to particulate matter and moisture.

There is therefore a need in the art for a muzzle cover that will substantially prevent dust and moisture from entering the bore thereof, that is easy to apply to and remove from the muzzle if necessary, and which will readily split apart and disengage from the muzzle upon a projectile being fired from the weapon and thereby substantially eliminating the possibility for injury from shrapnel.

SUMMARY OF THE INVENTION

The device of the present invention comprises a soft, flexible and resilient cover that slides over and frictionally engages the front end of a firearm muzzle. The cover comprises a substantially cylindrical sheath that is open at a first end to receive the front end of the muzzle therein and which frictionally engages the external surface of the muzzle. A conically shaped tip extends outwardly from a second end of the sheath. When the sheath is positioned over the front end of the muzzle, the conical tip extends forwardly away therefrom and covers the opening to the barrel. The conical tip may be left in a first position where it extends forwardly and outwardly away from the front of the sheath. Alternatively, the conical tip may be pushed inwardly into the interior of the sheath and thereby into the interior of the barrel. This is accomplished by the application of gentle pressure from a fingertip. The muzzle cover completely disengages from the muzzle when impacted by a projectile that is fired through the barrel of the firearm.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 1 is a side view of a firearm with a muzzle cover in accordance with the present invention engaged therewith;

FIG. 2 is an enlarged side view of the end of the muzzle and the muzzle cover;

FIG. 3 is a perspective front view of the muzzle cover;

FIG. 4 is a perspective rear view of the muzzle cover;

DETAILED DESCRIPTION OF THE INVENTION

Figure 5:
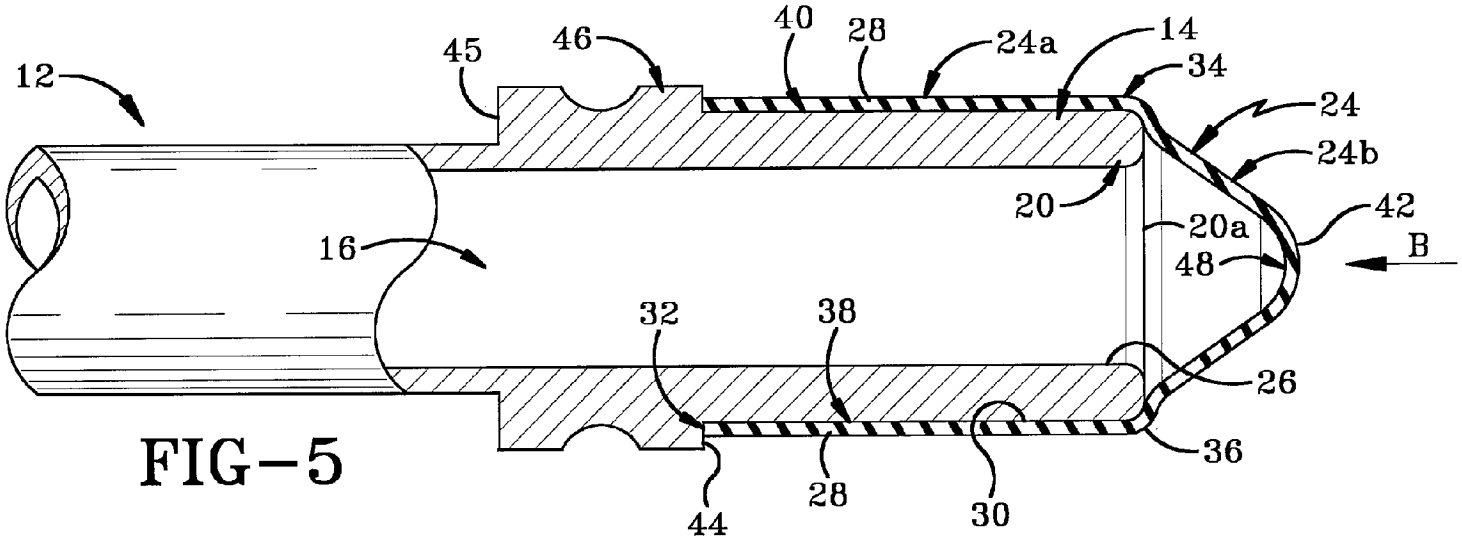
FIG. 5 is a partial cross-sectional side view of the end of the firearm muzzle with the muzzle cover engaged therewith and showing the conical tip extending outwardly away from a first end of the sheath and thereby being in a first position on the firearm.

Referring to FIGS. 1-7, there is shown a firearm 10 having a barrel 12 with a muzzle 14 at its forward end. Barrel 12 includes a hollow cylindrical bore 16 through which a projectile 18 may be fired. Muzzle 14 may include a compensator or muzzle brake at its front end 20 which includes one or more flash ports 22 that allow exhaust gases to escape from bore 16.

In accordance with a specific feature of the present invention, a muzzle cover 24 is provided for closing off access to the opening 26 (FIG. 5) of bore 16 and for preventing dust and moisture from entering therein. Muzzle cover 24 is designed to cover weapons with or without muzzle brakes. Cover 24 is particularly useful for covering the muzzles of a wide range of weapons including, but not limited to, all 5.56, 7.62, M203 40 mm, M2-50 caliber, MK19-3 mm (conical muzzle design), MK19-3 40 mm (straight muzzle design), 20 mm, 25 mm, 30 mm and 81 mm mortar small arms weapons. It will be understood that cover 24 may be applied to any other weapons that have barrels through which projectiles are fired.

In accordance with a specific feature of the present invention, muzzle cover 24 comprises a sheath section 24*a*, that is generally cylindrical in shape, and a conical tip 24*b*. Cover 24 is soft, flexible and lightweight and can be easily manipulated and twisted without tearing or cracking. Cover 24 is also resilient so that it returns to its original shape when released. Cover is manufactured from a natural rubber base that includes a filler which gives the rubber base a higher modulus of stiffness. Furthermore, cover 24 is latex dipped instead of being mold injected as are the currently known plastic muzzle covers. The walls of sheath section 24*a* and tip 24*b* are between 0.020 and 0.030 inches thick and preferably are 0.025 inches thick. This makes the walls of cover 24 between 40% and 60% thinner than currently used plastic caps which typically are 0.050 inches thick.

Figure 6:
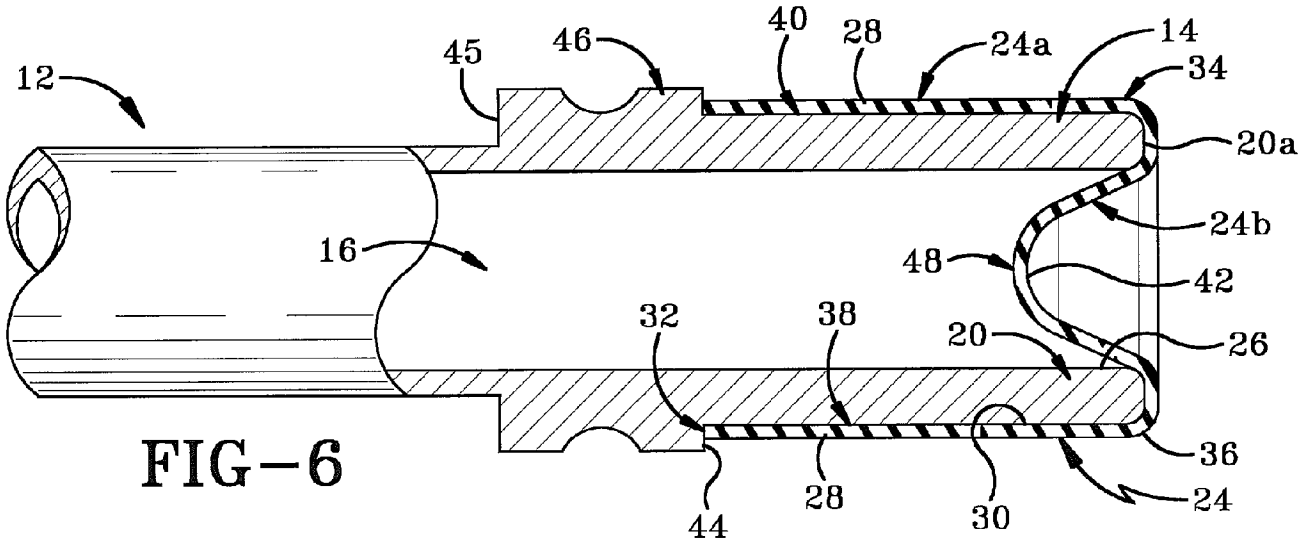
FIG. 6 is a partial cross-sectional side view of the end of the firearm muzzle with the cover engaged and showing the conical tip depressed inwardly into the interior of the sheath and thereby being in a second position on the firearm.

Referring to FIGS. 2-4, sheath section 24*a* comprises a peripheral wall 28 that surrounds and defines a cylindrical hollow interior bore 38 therein. Wall 28 originates at a first end 32 (FIG. 2) and terminates at a second end 34, with the length "L" of sheath 24*a* being defined between said first and second ends 32, 34. The length "L" of peripheral wall 28 is between 1.0 inch and 2.5 inches long and preferably is 2 inches long. It has been found through testing that cover 24 will completely disengage from muzzle 14 when the weapon is fired, leaving no visible residue on the muzzle, and cover 24 is 2.250 inches long when tip 24*b* is in the fully extended position (FIG. 5), and is 2 inches long when tip 24*b* is inverted (FIG. 6).

When sheath 24*a* is not engaged with muzzle 14, the bore 38 is of a substantially constant diameter along its entire length "L". The diameter of bore 38 will be slightly less than the exterior diameter of muzzle 14 that cover 24 is to be applied to. Consequently, when cover 24 is applied over muzzle 14, it tightly engages the exterior surface 40 of muzzle 14. Wall 28 of cover 24 is also substantially planar along its entire length "L" and is free of any projections extending either inwardly or outwardly away therefrom. Because of the flexible nature of cover 24, the diameter of bore 38 may become slightly distorted when cover 24 is applied over muzzle 14. Wall 28 and bore 38 are complementary sized and shaped to frictionally engage exterior surface 40 of muzzle 14 and to be retained thereon without any additional assistance or components. The interior surface 30 (FIG. 4) of wall 28 has a non-tacky finish so that wall 28 is able to slide easily over the exterior surface 40 of muzzle 14 and to readily conform thereto.

Figure 8:
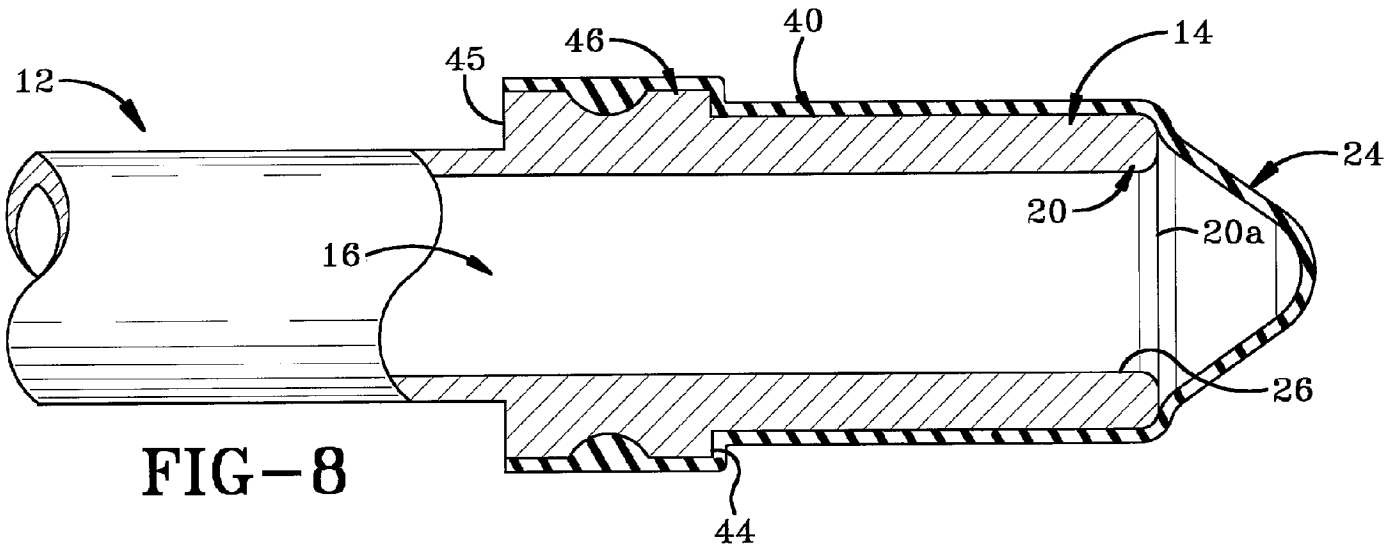
FIG. 8 is a partial cross-sectional side view of the end of the firearm and showing a longer cover that is disposed over the muzzle brake and with the tip of the cover extending outwardly away from the first end of the sheath.
Figure 9:
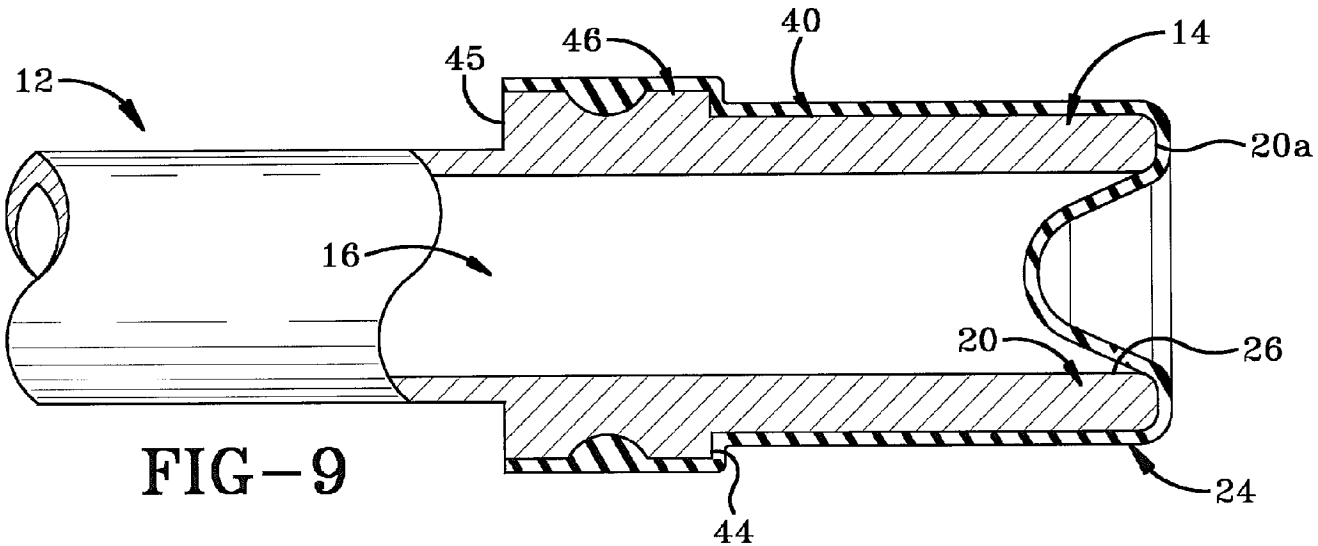
FIG. 9 is a partial cross-sectional side view of the end of the firearm of FIG. 8 and showing the tip of the cover depressed inwardly into the interior of the sheath.

In accordance with another specific feature of the present invention, conical tip 24*b* is integrally formed with sheath 24*a* and extends from second end 34 of wall 28. Tip 24*b* is connected to second end 34 at an annular collar 36. Collar 36 is disposed at a first angle relative to wall 28 and at a second angle relative to tip 24*b*. Muzzle cover 24 is sufficiently thin and flexible enough that tip 24*b* may be depressed inwardly (FIG. 6) so that the outermost end 42 thereof lies inwardly of collar 36 and within the bore 38 of cover 24. Collar 36 acts as a transition point for movement of conical tip 24*b* between a first position where tip 24*b* extends forwardly and outwardly away from second end 34 of peripheral wall 28, and a second position where tip 24*b* extends rearwardly and inwardly into bore 38 of sheath section 24*a*. Collar 36 could be very slightly reinforced so that the front face 20*a* of front end 20 of muzzle 14 may be internally seated against the same without causing damage to cover 24. When cover 24 is engaged with muzzle 14, conical tip 24*b* extends across the opening 26 of bore 16 and prevents access thereto. Tip 24*b* covers opening 26 and flash ports 22 when in either of the first and second positions relative to sheath section 24*a* and substantially prevents the ingress of particulate materials and moisture. FIGS. 8 and 9 show cover 24 being of a length sufficient to extend over the entire muzzle brake to the innermost end 45 of stop 46. In these instances, sheath 24*a* of cover 24 would be around 2.250 inches long.

Muzzle cover 24 is used in the following manner. Peripheral wall 28 of cover 24 is lightly grasped between the forefinger and thumb of the user's hand. Cover 24 is brought into contact with front end 20 of muzzle 14 and front end 20 is slid into bore 38 of cover 24 in the direction of arrow "A" (FIG. 2). The sliding movement is continued until face 20*a* of front end 20 abuts at least a portion of the interior wall of annular collar 36 and first end 32 of wall 28 abuts a shoulder 44 on a stop 46 on firearm 10. At this point, sheath 24*a* surrounds a portion of the exterior surface 40 of muzzle 14 and tip 24*b* extends across opening 26 of bore 16. Sheath 24*a* also extends over flash ports 22 (FIG. 2). In FIG. 6, tip 24*b* is shown in the first position and appears as a domed projection which extends outwardly and forwardly away from the face 20*a* of muzzle 14. Conical tip 24*b*, however, is sufficiently flexible and soft enough to allow the end 42 thereof to be pushed inwardly in the direction of arrow "B" (FIG. 5) using a fingertip and apply a gentle pressure. This movement causes conical tip 24*b* to be substantially inverted or dimpled and moved to the second position shown in FIG. 6. In the second position, tip 24*b* is concave in profile and is retained within bore 38 of cover 24 and thereby within bore 16 of muzzle 14. This completely seals off the opening 26 into bore 16. Cover 24 prevents dust and moisture from entering into bore 16 whether conical tip 24*b* is in either the first or the second position.

While tip 24*b* covers opening 26, it should be understood that even when tip 24*b* is in the second position, the barrel of the firearm 10 is not plugged. A plugged bore 16 would spell disaster for the soldier as it would cause the muzzle 14 to explode when a projectile 18 is fired through muzzle 14. A projectile 18 can readily be fired through tip 24*b* when tip 24*b* is in either of the first and second positions. The tip 24*b* does not prevent the projectile from exiting the muzzle 14 in any way. Cover 24 is essentially useful for preventing particulate materials from plugging or blocking bore 16.

When cover 24 is in the first position extending conically outwardly away from front end 20*a* of muzzle 14, cover 24 will tend to reduce air, wind and water drag on weapon 10, such as when a paratrooper exits a plane, for example. However, when cover 24 is in the second position, the soldier's potential vulnerability is reduced by eliminating the potential for enemy combatants to assume that the weapon 10 is not ready for engagement as it will not be apparent that anything is applied to cover the opening 26 to the muzzle 14.

Furthermore, it should be understood that a projectile 18 can be fired through cover 24 when in either of the first and second positions. The second position is, however, slightly more favorable for ensuring that cover 24 will completely disengage from weapon 10 because of the cover's 24 more snug fit when in this second position.

Figure 7:
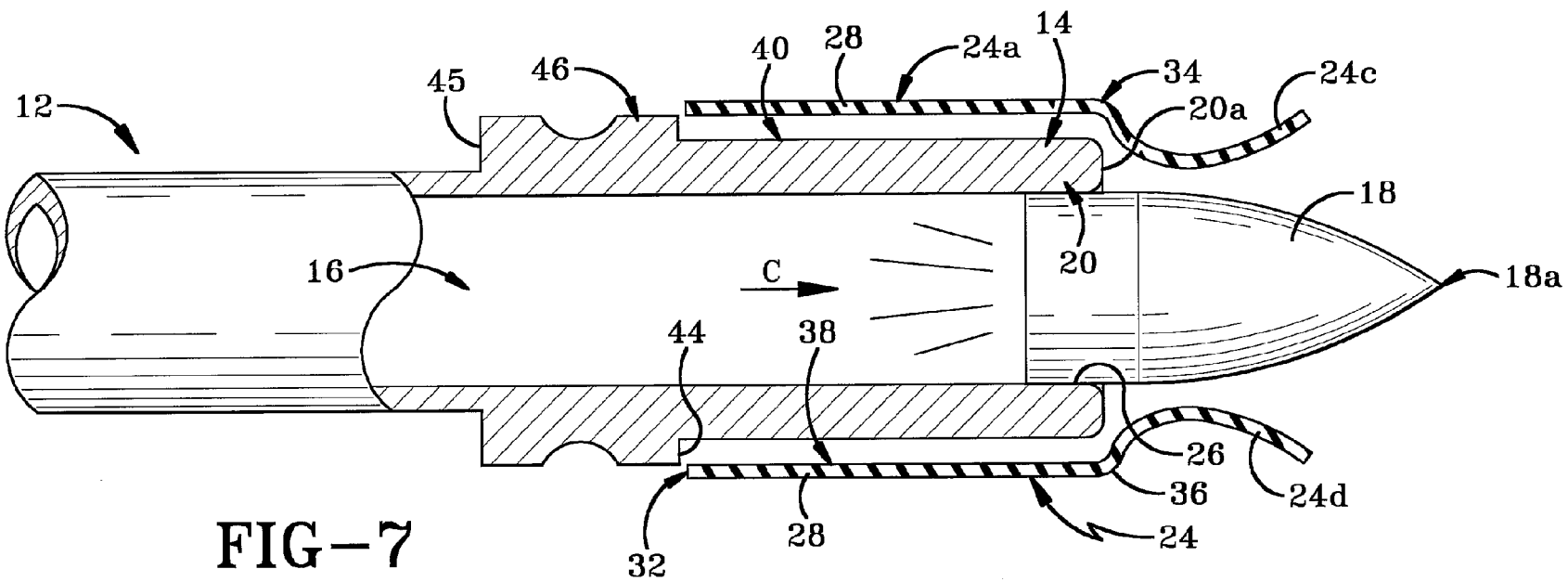
FIG. 7 is a partial cross-sectional side view of the end of the firearm muzzle with a bullet being fired therethrough and through the muzzle cover.

In accordance with yet another feature of the present invention, when a projectile 18 is fired from firearm 10, cover 24 is soft enough, flexible enough and of a suitable length to be completely disengaged from muzzle 14 by projectile 18 as it exits muzzle 14. Referring to FIG. 7, when projectile 18 is fired in the direction of arrow "C" through muzzle 14, flames, gases and air traveling in front of the tip 18*a* of the projectile 18 will encounter tip 24*b*. If the force of the flames, gases and air is sufficient, they might cause tip 24*b* to move from the second position (FIG. 6) back to the first position (FIG. 5) prior to tip 18*a* striking the interior surface 48 of end 42 of cover 24. When tip 18*a* of projectile 18 strikes end 42 of cover 24, the impact causes tip 24*b* of cover 24 to initially balloon slightly, forcing air between sheath 24*a* and exterior surface 40 of muzzle 14. Tip 24*b* then splits open, forcing remnants 24*c*, 24*d* of cover 24 away from the exterior surface 40 of muzzle 14. Remnants 24*c*, 24*d* are soft enough and flexible enough in nature that they do not become pieces of shrapnel that might injure the person firing the weapon or others surrounding them. It should be noted that cover 24 also does not impede or deflect projectile 18 from its original trajectory indicated by arrow "C". Because cover 24 completely disengages from muzzle 14 and no part of cover 24 remains engaged or attached to weapon 10 after firing, the need for any additional cleaning or maintenance of muzzle 14 to remove residue, is therefor eliminated. Previously known muzzle covers do not completely disintegrate or disengage and frequently melt onto the muzzle of the weapon, thus necessitating special cleaning of the muzzle in order to remove the melted residue therefrom.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A muzzle cover for engagement with an exterior surface of a front end of a muzzle of a weapon to restrict access to a bore of said muzzle; said cover comprising:

a resilient member that is adapted to slidingly engage around the exterior surface of the front end of the muzzle and to cover an opening to the bore of the muzzle, wherein the resilient member comprises:

a substantially cylindrical sheath portion; said sheath portion comprising a wall having a first end and a second end and defining a longitudinal bore therein-between, wherein the wall has a length between the first and second end thereof and said length is between 1 and 2½ inches, and wherein the sheath portion is substantially planar along its entire length and is free of internal and external projections; and a conical tip integrally formed with the sheath portion and extending away from the first end thereof; wherein said sheath portion is adapted to engage the exterior surface of the muzzle and the conical tip is adapted to extend across the opening to the bore.

2. The muzzle cover as defined in claim 1, further comprising:

an aperture defined in the second end of the sheath portion and adapted to receive the front end of the muzzle therethrough, and wherein the sheath portion is free of openings other than the aperture and is adapted to be retained on the front end of the muzzle by friction alone.

3. The muzzle cover as defined in claim 2, wherein said resilient member is adapted to completely disengage from the exterior surface of the muzzle when a projectile is fired through the bore.

4. The muzzle cover as defined in claim 2, wherein the resilient member is sufficiently soft and flexible to allow the member to be manipulated and which allows the member to return to its original shape after manipulation.

5. The muzzle cover as defined in claim 2, wherein the resilient member has an exterior wall manufactured from a natural rubber base.

6. The muzzle cover as defined in claim 5, wherein the exterior wall of the resilient member is between 0.020 and 0.030 inches in thickness.

7. The muzzle cover as defined in claim 6, wherein the exterior wall is 0.025 inches thick.

8. The muzzle cover as defined in claim 1, wherein the bore of the sheath portion has an internal diameter that is smaller than a diameter of the exterior surface of the front end of the muzzle it is adapted to engage; and wherein the sheath portion is adapted to frictionally engage the front end of the muzzle when applied thereto.

9. The muzzle cover as defined in claim 1, wherein the conical tip is flexibly movable between a first position where the tip projects outwardly away from the first end of the sheath portion, and a second position where the tip extends rearwardly inwardly of the first end of the sheath portion and into the bore thereof.

10. The muzzle cover as defined in claim 1, wherein the wall of the sheath portion is of a substantially constant internal diameter when disengaged from the muzzle.

11. The muzzle cover as defined in claim 1, wherein the length of the wall of the sheath portion is 2 inches.

12. The muzzle cover as defined in claim 1, wherein said resilient member is adapted to completely disengage from the exterior surface of the muzzle when a projectile is fired through the bore.

13. The muzzle cover as defined claim 1, further comprising an annular collar disposed between the sheath portion and the conical tip and the collar is reinforced.

14. The muzzle cover as defined in claim 13, wherein the annular collar is integrally formed with both the sheath portion and the tip and is adapted to engage a front edge of the muzzle of the weapon.

15. In combination:

a weapon having a muzzle that includes a bore through which a projectile may be fired;

a muzzle cover for engagement with an exterior surface of a front end of the muzzle of the weapon to restrict access to the bore of said muzzle; said cover comprising:

a resilient member that is adapted to slidingly engage around the exterior surface of the front end of the muzzle and to cover an opening to the bore of the muzzle, wherein the resilient member comprises:

a substantially cylindrical sheath portion; said sheath portion comprising a wall having a first end and a second end and defining a longitudinal bore therein-between, wherein the wall has a length between the first and second end thereof and said length is between 1 and 2½ inches, and wherein the sheath portion is substantially planar along its entire length and is free of internal and external projections: and a conical tip integrally formed with the sheath portion and extending away from the first end thereof: wherein said sheath portion is adapted to engage the exterior surface of the muzzle and the conical tip is adapted to extend across the opening to the bore.

16. The combination as defined in claim 15, wherein the tip is movable between a first position, where the tip extends outwardly away from the sheath and therefore outwardly away from the front end of the muzzle; and a second position where the tip extends into the bore of the sheath and therefore inwardly of the front end of the muzzle.

17. The combination as defined in claim 16, wherein the resilient cover is manufactured from a material that is sufficiently soft and flexible that the cover disengages completely from the front end of the muzzle when a projectile is fired from the weapon.

* * * * *